United States Patent [19]

Ford et al.

[11] Patent Number: 4,824,002

[45] Date of Patent: Apr. 25, 1989

[54] CONTACTLESS WEB SUPPORT GUIDE

[76] Inventors: John W. Ford, 54 Chesham Road, Kingston Upon Thames, Surrey KT1 3AQ; Maurice J. Dyer, 3 Sylvan Avenue, Mill Hill, London, N.W.7, both of England

[21] Appl. No.: 58,279

[22] Filed: Jun. 4, 1987

[30] Foreign Application Priority Data

Jun. 6, 1986 [GB] United Kingdom ..... 8613764
May 1, 1987 [GB] United Kingdom ..... 8710433

[51] Int. Cl.[4] ..... B65H 23/24
[52] U.S. Cl. ..... 226/197; 226/97
[58] Field of Search ..... 226/97, 197; 34/156

[56] References Cited

U.S. PATENT DOCUMENTS

| | | | |
|---|---|---|---|
| 3,313,462 | 4/1967 | Smith, Jr. | 226/97 |
| 3,984,039 | 10/1976 | Hawley et al. | 226/97 |
| 4,182,472 | 1/1980 | Peekng | 226/97 |
| 4,197,972 | 4/1980 | Daane | 226/97 |

*Primary Examiner*—John M. Jillions
*Attorney, Agent, or Firm*—Burns, Doane, Swecker & Mathis

[57] ABSTRACT

A contactless support guide for a web of material is described. The guide comprises a web support face, a pressurized air supply manifold, and a plenum chamber positioned between the manifold and the support face. The support face is provided with a plurality of pockets, each pocket having an air inlet aperture leading to the plenum chamber. Means are provided for increasing the air pressure at the longitudinal edges of the support face at which the web enters and exits.

17 Claims, 4 Drawing Sheets

CONTACTLESS WEB SUPPORT GUIDE

BACKGROUND OF THE INVENTION

This invention relates to a contactless support guide for a web of material.

Contactless web support guides are incorporated in printing machines, usually when it is required to print both sides of a web of material without intermediate drying between the two printing processes. In effect, they are air bearing devices which replace specific rollers of the printing machine, thereby preventing smudging. Typically, such support guides are used to change the direction of motion of a web (usually through 90°), in which case they are referred to as "air turns". Air turns are usually used in pairs to reverse the direction of motion of a web. Similar support guides (known as "air bars") are used to support and guide webs without changing their direction of motion.

There are two main problems which a successful contactless support guide must overcome. Firstly, the air pressure between the underside of the web and the support face must be even, and as low as possible consistent with the keeping of a layer of air between the two surfaces, even though the web tension varies and the escape of air at the web entry and exit regions of the support face causes a reduction in pressure at these regions. Any unevenness of air pressure will tend to cause ballooning out of the web, which leads to instability and possibly bursting. Secondly, it is essential that the contactless support guide maintains lateral stability of the web, whilst preventing the web from touching the support face. The constant demand for ever increasing outputs, with the resulting increased web speeds, has led to longer unsupported web runs in the latest machines, particularly in their drying units. Known contactless support guides are inadequate in this respect. They are also extremely noisy.

The aim of the invention is to provide a contactless support guide which maintains the stability of the web at high speeds, and is quieter than known devices.

SUMMARY OF THE INVENTION

The present invention provides a contactless support guide for a web of material, the guide comprising a web support face, and a pressurised air supply manifold, wherein the support face is provided with a plurality of pockets. Means are provided for directing pressurised air into the pockets whereby the web can be supported in spaced relationship to the support face by an air cushion. Means are provided for increasing the air pressure at the web entry and exit regions of the support face.

In a preferred embodiment, a plenum chamber is positioned between the manifold and the support face. In this case, each pocket may be provided with an air inlet aperture leading to the plenum chamber, the inlet apertures constituting the means for directing pressurised air into the pockets.

In some cases, it is preferable if the inlet apertures of the pockets in the region of the support face which is central with respect to the direction of movement of a web over the support face are smaller than the inlet apertures of the pockets at the web entry and exit regions of the support face. Preferably, the inlet apertures of the pockets in said central region have a diameter of 1/16th inch, the inlet apertures of the pockets in said entry and exit regions have a diameter of ¼ inch, the diameters of the inlet apertures being graded from said central region to the entry and exit regions.

Advantageously, the pockets are arranged in rows which extend at right-angles to the direction of movement of a web over the support face. In this case, the guide may further comprise slats positioned at the web entry and exit regions, each slat partially overlying, or projecting into, the pockets of the adjacent row, the slats constituting the means for increasing the air pressure at the web entry and exit regions. Preferably, each of the slats is adjustably mounted on the support face, and the leading edge of each slat is inclined.

In a preferred embodiment, the guide further comprises an elongate pocket extending along each of the longitudinal edges of the support face at the web entry and exit regions, each elongate pocket being provided with a plurality of inlet apertures leading to the plenum chamber, the elongate pockets and their inlet apertures being angled towards the centre of the support face, the elongate pockets and their inlet apertures constituting the means for increasing the air pressure at the web entry and exit regions. Advantageously, each of the elongate pockets has a width of ⅜ inch and a maximum depth of ⅜ inch, and the inlet apertures each have a diameter of 3/16 inch and are spaced apart by ¼ inch.

Preferably, each of the pockets is circular, having a diameter of 1 inch and a depth of ⅜ inch.

Conveniently, the guide further comprises an air distribution baffle positioned in the plenum chamber in the air flow path from the manifold to the support face. Preferably, the baffle is formed with a plurality of apertures.

In another preferred embodiment, the manifold is constituted by a pair of tubes positioned at the longitudinal edges of the support face, each of the tubes being provided with a plurality of holes through which pressurised air can be directed towards the adjacent longitudinal edge of the support face, said holes constituting the means for directing pressurised air into the pockets and the means for increasing the air pressure at the web entry and exit regions of the support face.

Advantageously, the support face is arcuate and of such dimensions as to support and guide a web for movement through an angle of substantially 90°. Alternatively, the support face is gently curved so as to support and guide a web moving generally rectilinearly.

BRIEF DESCRIPTION OF THE DRAWINGS

Four forms of contactless web support guide, each of which is constructed in accordance with the invention, will now be described, by way of example, with reference to the accompanying drawings, in which.

DESCRIPTION OF PREFERRED EMBODIMENTS

Figure 1:
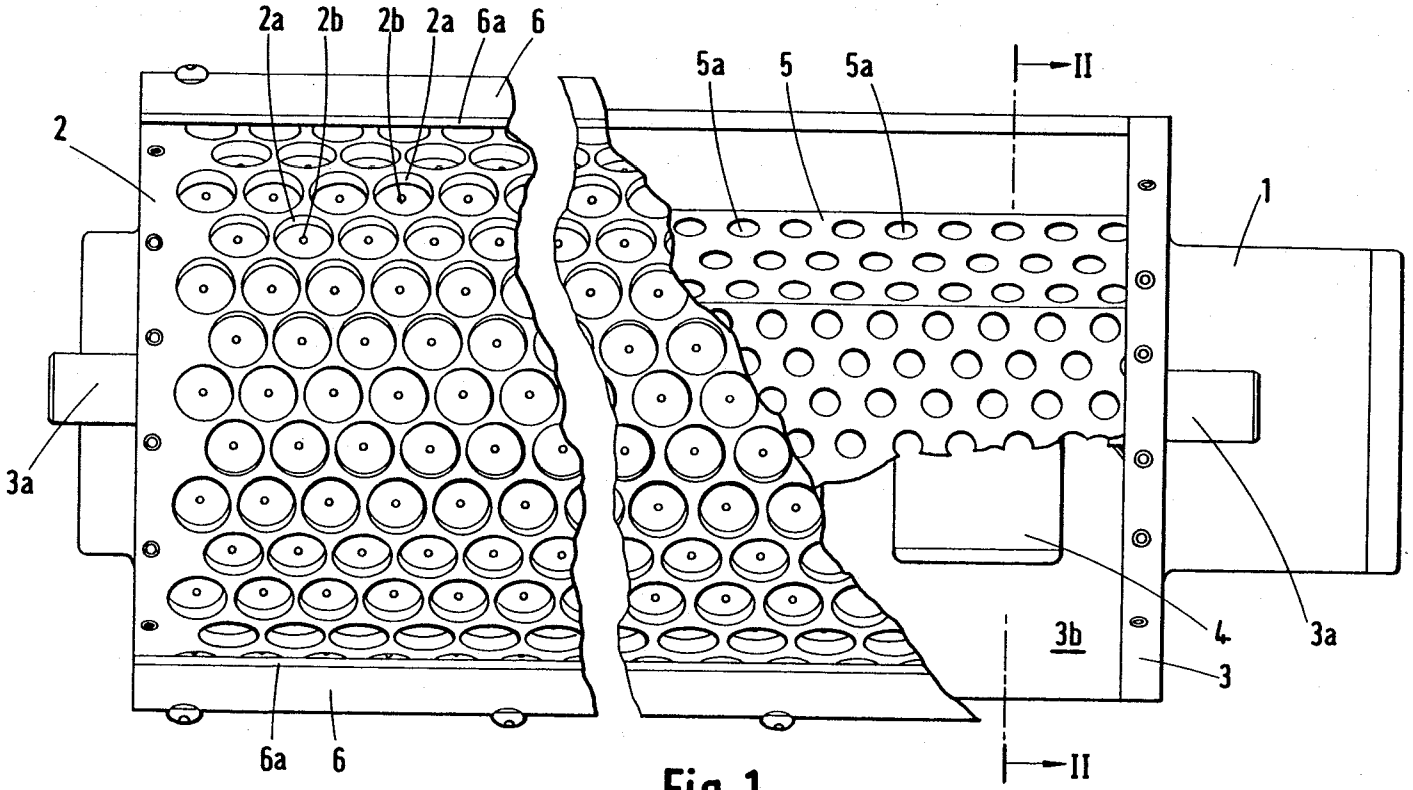
FIG. 1 is a side elevation, partially broken away, of the first form of contactless support guide.
Figure 2:
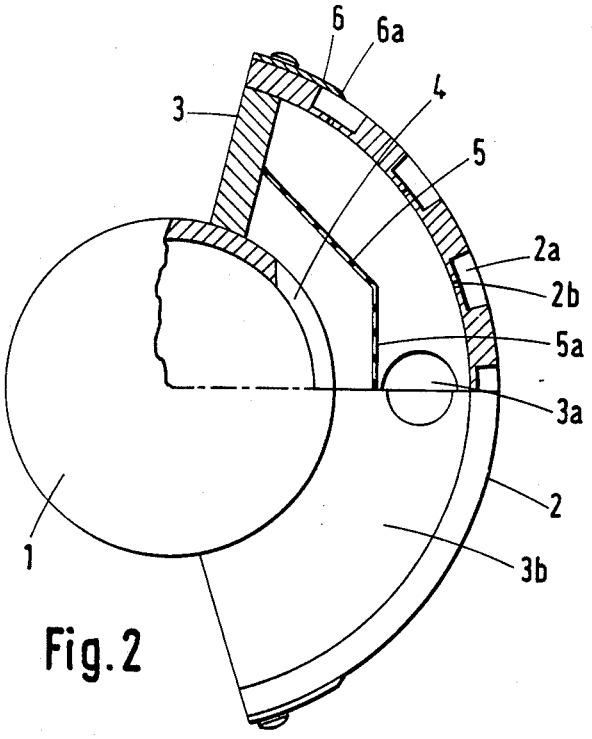
FIG. 2 is a cross-section taken on the line II—II of FIG. 1.

Referring to the drawings, FIGS. 1 and 2 show a contactless web support guide known as an air turn. The air turn has a tubular air supply manifold 1, and an arcuate support face 2 supported on the manifold by a body 3. In use, the air turn is supported by a pair of handles 3*a* provided at the ends of the body 3. A cut-out 4 formed in the manifold 1 permits air to pass from the manifold to the support face 2. The body 3 defines a plenum chamber 3*b* between the manifold 1 and the support face 2. The plenum chamber 3*b* helps to equalise air pressure along the length of the support guide. The support face 2 has a length of about 3 feet and a radius of about 6 inches. The arcuate support face 2 extends over an arc which is sufficiently long to guide a web passing thereover through a substantially 90° turn. An air spreader baffle 5 is fixed to the body 3 within the plenum chamber 3*b* in the air flow path from the cut-out 4 to the support face 2. The baffle 5 helps to even out the air pressure along the air turn device, having a large number of circular apertures 5*a* of ½ inch diameter.

The support face 2 is provided with rows of circular pockets 2*a*, each having a diameter of 1 inch and a depth of ⅜ inch. The pockets are supplied with air via inlet holes 2*b*. The inlet holes 2*b* adjacent to the longitudinal edges of the support face 2 have a diameter of ¼ inch, the inlet holes at the centre have a diameter of 1/16 inch, and the remaining inlet holes have diameters graded from 1/16 inch at the centre to ¼ inch at the edges of the support face.

Slat 6 is provided at each of the longitudinal edges of the support face 2 and is mounted for example, with screws for adjustment relative to the face 2. Each slat 6 overlies the pockets 2*a* of the row of pockets adjacent to that edge. Each slat 6 has a sloping leading edge 6*a*.

In use, pressurised air is supplied to the manifold 1. This air passes through the apertures 5*a* in the baffle 5, and out over the support face 2 via the holes 2*b* and the pockets 2*a*. The air emerging from the pockets 2*a* forms a pressurised cushion between the support face 2 and a web of material (not shown) which is supported and guided by the air turn. The pressurised air is supplied to the manifold 1 by an impeller (not shown) which is controlled by an orthodox controllor (not shown) whose output is dependent upon the web tension. Thus, the pressure of the air cushion at the support face 2 is dependent upon the web tension.

This air turn overcomes the two problems referred to above. Thus, the provision of the rows of circular pockets 2*a* results in an even and low pressure cushion over the support face 2, whilst maintaining lateral web stability. This is because the pressurised air emerging from the pockets 2*a* tends to stabilise the web, probably by establishing a static pressure pattern over the support face 2, which prevents the web moving laterally. The grading of the holes 2*b* from the centre of the support face 2 towards the two longitudinal edges helps to give an even layer of air over the support face. This grading also results in a larger air pressure at the two longitudinal edges than elsewhere on the support face 2, and so helps to ensure sufficient air pressure at the web entry and exit regions of the support face. The provision of the slats 6 also helps to ensure the maintenance of air pressure at these entry and exit regions, the slats creating a local increase in pressure (see FIG. 3 which shows the exit region of the air turn, and how the pressure build-up—indicated by the small arrows—pushes the web W away from the support face 2). The adjustability of the slats 6 permits adjustment of the pressure of the air cushion at the longitudinal edges of the support face 2. At the same time, the sloping edges 6*a* of the slats 6 divert the air flow obliquely away from the support face 2, thereby pushing the web away from the support face at the entry and exit regions.

Apart from overcoming the usual two problems, this air turn also has the advantage of being relatively silent when compared with known air turn devices which rely on jets of air at the entry and exit regions.

Figure 3:
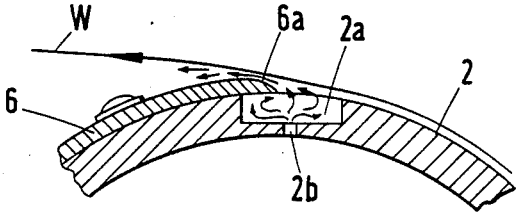
FIG. 3 is an enlarged view of part of the guide shown in FIG. 2.
Figure 4:
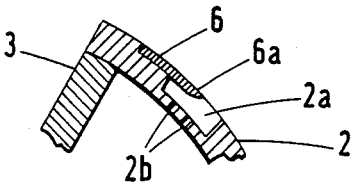
FIG. 4 is a view, similar to that of FIG. 3, of a modification of the first form of guide.

FIG. 4 shows a modified arrangement which results in an increase in the air pressure at the two longitudinal edges of the support face 2. This improvement is achieved by positioning the slats 6 so as to project into the adjacent pockets 2*a* (rather than overlying them as in the case with the embodiment shown in FIGS. 1 to 3), and by providing each of these pockets with two or more holes 2*b*. This results in an increase in the air pressure in the pockets 2*a* adjacent to the longitudinal edges of the support face 2.

Figure 5:
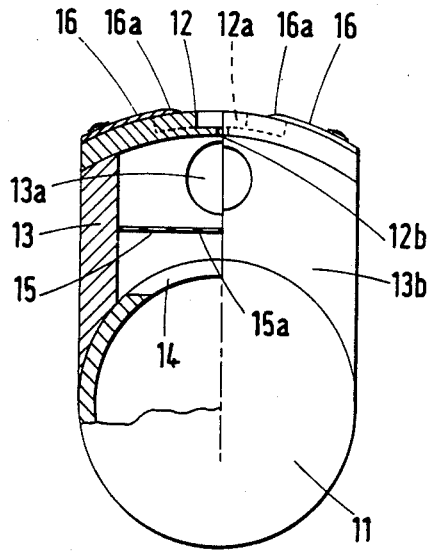
FIG. 5 is a transverse cross-section through the second form of contactless support guide.

FIG. 5 shows a second form of contactless web support guide. This support guide (air bar) is intended to support and guide a web travelling generally in a rectilinear manner. Thus, this support guide has an arcuate support face 12 which is curved only slightly. In other respects, this support guide is similar to the air turn shown in FIGS. 1 and 2, in that it has a supply manifold 11, a body 13 having a pair of handles 13*a*, a plenum chamber 13*b*, cut-out 14, an air spreader baffle 15 having apertures 15*a* and holes 15*b*, and a pair of adjustable slats 16 having inclined leading edges 16*a*. As with the embodiment of FIGS. 1 and 2, the pockets 12*a* are arranged in rows (in this case three rows), the holes 12*b* in the centre having a diameter of 1/16 inch and the holes 2*b* in the two outer rows having a diameter of ¼ inch.

Figure 6:
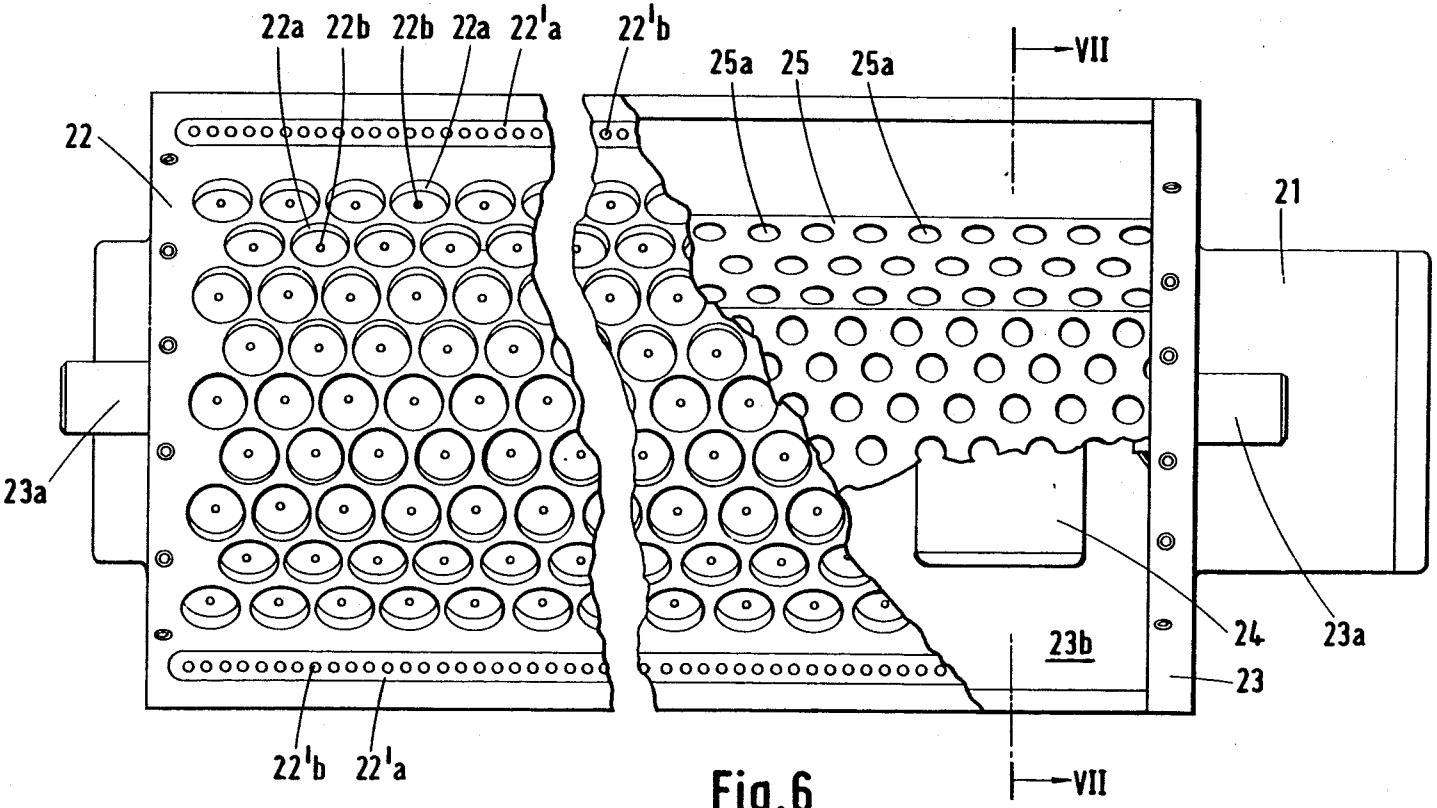
FIG. 6 is a side elevation, partially broken away, of the third form of contactless support guide.
Figure 7:
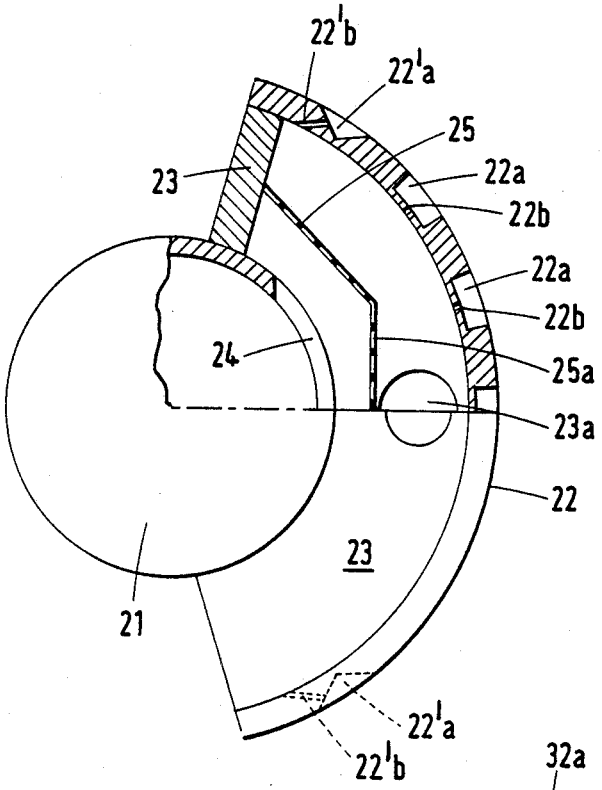
FIG. 7 is a cross-section taken on the line VII—VII of FIG. 6.

FIGS. 6 and 7 shows a third form of contactless web support guide which is a modification of that shown in FIGS. 1 to 3. Thus, the air turn has a tubular air supply manifold 21, and an arcuate support face 22 supported on the manifold by a body 23. In use, the air turn is supported by a pair of handles 23*a* provided at the ends of the body 23. A cut-out 24 formed in the manifold 21 permits air to pass from the manifold to the support face 22. The body 23 defines a plenum chamber 23*b* between the manifold 21 and the support face 22. The support face 22 has a length of about 3 feet and a radius of about 6 inches. The arcuate support face 22 extends over an arc which is sufficiently long to guide a web passing thereover through a substantially 90° turn. An air spreader baffle 25 is fixed to the body 23 in the air flow path from the cut-out 24 to the support face 22. The baffle 25 helps to even out the air pressure along the air turn device, having a large number of circular apertures 25*a* of ½ inch diameter.

The support face 22 is provided with rows of circular pockets 22*a*, each having a diameter of 1 inch and a depth of ⅜ inch. The pockets 22*a* are supplied with air via inlet holes 22*b*. The inlet holes 22*b* have a diameter of ⅛ inch. Adjacent to each longitudinal edge, the support face 22 is provided with an elongate pocket 22'*a*, each of which has a width of ⅜ inch and a maximum depth of ⅜ inch. The pockets 22'*a* are supplied with pressurised air via inlet holes 22'*b* which have a diameter of 3/16 inch and which are spaced apart by ¼ inch.

Instead of the adjustable slats provided at longitudinal edges of the support face of the air turn shown in FIGS. 1 to 3, the pockets 22'a and the inlet holes 22'b adjacent to the longitudinal edges of the support faces 22 of this air turn are angled towards the centre of the support face.

In use, pressurised air is supplied to the manifold 21. This air passes through the apertures 25a in the baffle 25, and out over the support face 22 via the holes 22b, 22'b and the pockets 22a, 22'a. The air emerging from the pockets 22a, 22'a forms a pressurised cushion between the support faces 22 and a web of material (not shown) which is supported and guided by the air turn. The pressurised air is supplied to the manifold 21 by an impeller (not shown) which is controlled by an orthodox controller (not shown) whose output is dependent upon the web tension. Thus, the pressure of air cushion at the support face 22 is dependent upon the web tension.

This air turn also overcomes the two problems referred to above. Thus, the provision of the rows of circular pockets 22a results in an even and low pressure cushion over the support face 22, whilst maintaining lateral web stability. This is because the pressurised air emerging from the pockets 22a tends to stabilise the web, probably by establishing a stationary pressure pattern over the support face 22, which prevents the web from moving laterally. Stability is further improved because the air passing through the inclined holes 22'i b and apertures 22'a causes ridges or corrugations to form longitudinally in the web. The provision of the angled pockets 22'a and inlet holes 22'b at the longitudinal edges of the support face 22 also helps to ensure the maintenance of air pressure at these entry and exit regions, and also diverts the air flow obliquely away from the support face 22, thereby pushing the web away from the support face at the entry and exit regions.

As with the air turn of FIGS. 1 to 3, this air turn also has the advantage of being relatively silent when compared with known air turn devices which rely on jets of air at the entry and exit regions.

The air turn of FIGS. 6 and 7 can work with much higher web tensions than those of FIGS. 1 to 4, and so is the preferred embodiment of the invention. Moreover, because of the increase in stability which results from the longitudinal ridging caused by the inclined pockets 22'a and holes 22'b, it is possible to dispense with the direct supply of pressurised air to the circular pockets 22a, that is to say the inlet holes 22b can be dispensed with. In this case, the pockets 22a are supplied with pressurised air indirectly—via the pockets 22'a and the web of material.

Figure 8:
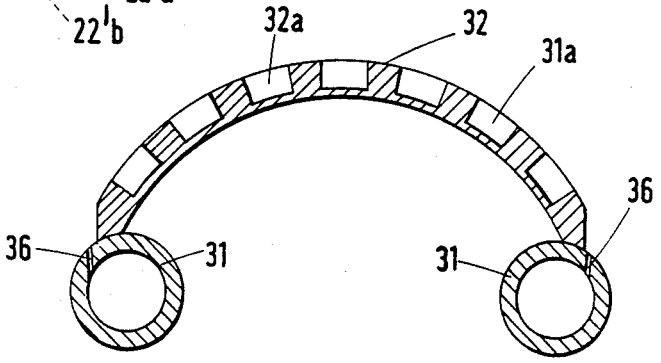
FIG. 8 is a transverse cross-section taken through the fourth form of contactless support guide.

FIG. 8 shows a further form of contactless web support guide whose circular pockets are not directly supplied with pressurised air. Thus, FIG. 8 shows an air turn having a pair of tubular air supply tubes 31, and an arcuate support face 32 whose longitudinal edges are fixed to the air supply tubes. Each of the tubes 31 has an external diameter of 3 inches, an internal diameter of $2\frac{1}{2}$ inches, and is provided with a plurality of holes 36 extending along that tube in line with the adjacent longitudinal edge of the support face 32. The holes have a diameter of 3/16 inch, a spacing of $\frac{1}{4}$ inch, and are positioned to direct air flow from the tube interior towards the adjacent longitudinal edge of the support face 32. The support face 32 has a length of about 3 feet and a radius of about 6 inches. The support face 32 is provided with rows of circular pockets 32a, each having a diameter of 1 inch and a depth of $\frac{3}{8}$ inch. The pockets 32a are distributed in a similar manner to the pockets 2a of the embodiment of FIG. 1.

In use, pressurised air is supplied to the tubes 31 via inlets (not shown) formed in their central regions. This pressurised air emerges from the holes 36 and forms a pressurised air cushion behind a web (not shown) of material passing over the support face 32. The web itself is instrumental in directing the air flow over the support face 32 and into the pockets 32a. Once again, this air turn overcomes the problems referred to above. In particular, the pressurised air in the pockets 32a results in an even and low pressure cushion over the support face 32, whilst maintaining lateral web stability. This lateral stability is enhanced by the longitudinal ridging which results from the air flow through the holes 36.

It will be apparent that the contactless web support guides described above could be modified in a number of ways. For example, the grading of the inlet holes 2b of the embodiments of FIGS. 1 to 4 is not essential, so all these inlet holes could have the same diameter. Moreover, lateral stability can also be achieved by lifting the centre of the web slightly (for example by about $\frac{1}{8}$ inch), so that the web is curved slightly from edge to edge. This can be accomplished either by curving the support face from edge to edge, or by increasing the air pressure in the central region of the web.

We claim:

1. A contactless support guide for guiding a moving web of material, comprising:

means defining an arcuate support face for controlling the moving web;

a first plurality of pockets within the support face and distributed over the support face;

an air supply manifold for receiving pressurized air;

means for establishing communication between the air supply manifold and the pockets to create an air cushion extending around the support face to support the moving web in a generally uniform spaced relationship to the support face;

the total cross-sectional area of the pockets taken at the support face being greater than the cross-sectional area of the support face between the pockets;

an elongate pocket provided in the support face at a region where the web enters the guide and an elongate pocket provided in the support fact at a region where the web exits the guide; and means provided for establishing communication between the manifold and the elongate pockets to provide higher pressure in the air cushion at said regions relative to the remainder of the air cushion.

2. A support guide according to claim 1, wherein the elongate pockets are angled towards the first plurality of pockets.

3. A support guide according to claim 1, wherein a plenum chamber is positioned between the manifold and the support face.

4. A support guide as claimed in claim 3, wherein each pocket is provided with an air inlet aperture leading to the plenum chamber.

5. A support guide according to claim 4, wherein the inlet apertures of the pockets in the region of the support face which is central with respect to the direction of movement of a web over the support face are smaller than the inlet apertures of the pockets at the web entry and exit regions of the support face.

6. A support guide according to claim 5, wherein the inlet apertures of the pockets in said central region have a diameter of 1/16th inch, the inlet apertures of the pockets in said entry and exit regions have a diameter of $\frac{1}{4}$ inch, the diameters of the inlet apertures being graded from said central region to the entry and exit regions.

7. A support guide according to claim 1, wherein the first plurality of pockets are arranged in rows which extend at right-angles to the direction of movement of the web.

8. A support guide according to claim 1, wherein a plenum chamber is positioned between the manifold and the support face and each elongate pocket is provided with a plurality of inlet apertures leading to the plenum chamber.

9. A support guide according to claim 8, wherein each of the elongate pockets has a width of $\frac{3}{8}$ inch and a maximum depth of $\frac{3}{8}$ inch, and the inlet apertures each have a diameter of 3/16 inch and are spaced apart by $\frac{1}{4}$ inch.

10. A support guide according to claim 8, wherein the elongate pockets and their inlet apertures are angled towards the first plurality of pockets.

11. A support guide according to claim 1, wherein the arcuate extent of the support face is of such dimensions as to guide the web for movement through an angle of substantially 90°.

12. A support guide according to claim 1, wherein the support face is curved so as to guide the web for movement generally rectilinearly.

13. A support guide according to claim 1, wherein each of the first plurality of pockets is circular, having a diameter of 1 inch and depth of $\frac{3}{8}$ inch.

14. A support guide according to claim 1, further comprising an air distribution baffle positioned in the plenum chamber in the air flow path from the manifold to the support face.

15. A support guide according to claim 14, wherein the baffle is formed with a plurality of apertures.

16. A contactless support guide for guiding a web of material, said guide comprising:

means defining an arcuate support face for controlling the moving web;

a first plurality of pockets within the support face and distributed over the support face;

an air supply manifold for receiving pressurized air;

means for establishing communication between the manifold and the pockets to create an air cushion extending around the support face to support the moving web in a generally uniform spaced relationship to the face;

a second plurality of elongate air pockets in the support face at the regions of said support face where the web enters and exits the support guide;

each pocket includes an inlet air aperture leading to the communication means;

wherein the inlet air apertures of the first plurality of pockets are smaller than the inlet air apertures of the second plurality of pockets.

17. In a contactless support guide for guiding a web of material, said guide comprising means defining an arcuate support face for controlling the moving web; a first plurality of pockets within the support face and distributed over the support face; an air supply manifold for receiving pressurized air; means for establishing communication between the manifold and the pockets to create an air cushion extending around the support face to support the moving web in a generally uniform spaced relationship to the face; a second plurality of elongate air pockets in the support face at the regions of said support face where the web enters and exits the support guide; each pocket includes an inlet air aperture leading to the communication means;

an improved method of maintaining lateral stability of the web, comprising:

passing pressurized air to the regions of the air cushion where the web enters and exits the guide via the elongate pockets in the support face; and causing corrugations in the web in the direction of its movement.

* * * * *